US009303379B1

(12) United States Patent
Randolph

(10) Patent No.: US 9,303,379 B1
(45) Date of Patent: Apr. 5, 2016

(54) THERMAL INSULATION BARRIER SYSTEM

(71) Applicant: Rodney Randolph, Kearney, NE (US)

(72) Inventor: Rodney Randolph, Kearney, NE (US)

( * ) Notice: Subject to any disclaimer, the term of this patent is extended or adjusted under 35 U.S.C. 154(b) by 0 days.

(21) Appl. No.: 14/576,555

(22) Filed: Dec. 19, 2014

Related U.S. Application Data

(60) Provisional application No. 61/919,359, filed on Dec. 20, 2013.

(51) Int. Cl.

| | |
|---|---|
| ***E04C 2/38*** | (2006.01) |
| ***E02D 5/20*** | (2006.01) |
| ***E04B 1/16*** | (2006.01) |
| ***E04B 1/41*** | (2006.01) |
| ***E04B 1/76*** | (2006.01) |
| *E04B 1/38* | (2006.01) |

(52) U.S. Cl.
CPC ... *E02D 5/20* (2013.01); *E04B 1/16* (2013.01); *E04B 1/40* (2013.01); *E04B 1/7608* (2013.01); *E04B 1/7629* (2013.01); *E04B 2001/405* (2013.01); *E04B 2001/7679* (2013.01)

(58) Field of Classification Search
CPC ..... E02D 5/20; E04B 1/7621; E04B 1/7608; E04B 1/40; E04B 1/16; E04B 2001/405; E04B 2001/7679; E04B 1/344; E04B 2001/386
USPC ..... 52/220.8, 481.1
See application file for complete search history.

(56) References Cited

U.S. PATENT DOCUMENTS

| | | | | |
|---|---|---|---|---|
| 4,726,155 | A * | 2/1988 | Nahmias | E04B 1/344 52/71 |
| 5,737,895 | A * | 4/1998 | Perrin | 52/745.1 |
| 2008/0011994 | A1 * | 1/2008 | Howe et al. | 256/27 |

* cited by examiner

*Primary Examiner* — Patrick Maestri

(57) ABSTRACT

An improved thermal insulation barrier system for use in a grade beam, footing and wall assembly is disclosed. According to a preferred embodiment, the system includes a plurality of insulation panels which are interlocked with fasteners and aligned beneath a building envelope and extending inside of the grade beam, footing, and wall assembly. The plurality of panels is preferably aligned proximate to an exterior wall.

1 Claim, 6 Drawing Sheets

THERMAL INSULATION BARRIER SYSTEM

RELATED APPLICATIONS

The present application claims priority to U.S. Provisional Application No. 61/919,359 filed Dec. 20, 2013.

FIELD OF INVENTION

The present invention is related in general to the field of building insulation systems and, more particularly, to an improved thermal insulation barrier system and method for providing a continuous thermal insulation barrier for a grade beam, footing and wall assembly as part of a building envelope.

BACKGROUND OF THE INVENTION

Footings, piers, grade beams and the like are used in the construction of most building types. Moisture control, drainage, and frost protection along with structural load bearing are the primary concerns of a high performance foundation. Ideally, the foundation works to control infiltrating moisture by simultaneously channeling rain or 'free' water downwards and away from the foundation while also halting wicking moisture. Further, the foundation ideally protects against frost and the effects of freezing and thawing soils. Additionally, the foundation should act to reduce infiltration and exfiltration of air and harmful gases from the surrounding soils. In addition, the foundation must be capable of supporting the super-imposed loads of the structure above while resisting the lateral loads imposed by the surrounding soil and the hydrostatic pressures of the water within the soil.

A building's footing assembly is typically constructed of porous concrete components which have a very low thermal resistance. In order to improve the thermal resistance of a footing assembly and to block thermal transfer, insulation is usually installed on the concrete wall, footing and/or grade beam. This insulation becomes part of the overall building envelope and can have major effects on the performance of a building's envelope during its life cycle.

One of the most common methods of insulating the footing assembly is utilizing insulating foams such as those of rigid extruded polystyrene and expanded polystyrene. These rigid foams are generally employed in the form of rectangular panels or boards attached to the foundation walls to provide the necessary thermal break to reduce thermal conductivity. These conventional insulation systems are subject to many variables that can affect their life cycle performance.

The most prominent flaw in current insulation technology is that there are no systems available that allows the footing insulation to be installed directly in-line with or integrated as part of the above grade building envelope. Currently, on typical footings, the entire top face of below grade footings is exposed to thermal conductivity, which allows direct thermal penetration below the wall assemblies causing the interior (typically concrete) floors to conduct exterior temperatures directly into the interior spaces.

Other flaws in the current conventional insulation systems include variations in the sidewalls of the excavated earth in which the conventional insulation is being installed. Due to the inconsistencies caused by common digging techniques, the placement of the current insulation at the face and/or rear of the excavated footing is not uniform. As a result, the rigid insulation bends and breaks because it is forced outward when the concrete is poured. Additionally, current insulation panels are typically installed with standard eight-foot panels that have a square edge that is butted up together with other panels without mechanical fasteners or any ability to be jointed together. This causes these panels to separate and become uneven at the joints which provides additional thermal bridging and allows cold/heat transfer past the building envelope.

Another break in the thermal barrier of below-grade concrete footings is caused by the damage that occurs after the concrete footings and insulations are placed. Much of this damage is caused by the mechanical, electrical and plumbing subcontractors and other trades as they construct their portions of the building project. These subcontractors typically dig down on both sides of the newly placed concrete footing, removing the insulation barrier in order to rough-in the pipes, conduits and other penetrations so that they can have pathways to feed their needed building equipment. They will also drive over these concrete footings and insulation with their heavy construction equipment and thus damage and break the insulation system from above.

Based on the foregoing, there is a need for an improved thermal insulation barrier system that will provide adequate insulation for a grade beam, footing and wall assembly. Such an improved thermal insulation barrier system would provide reliable interlocking of multiple rigid insulation panels. Additionally, it would provide a continuous alignment of rigid panels beneath a building envelope. Further, such an improved thermal insulation barrier system would provide a continuous thermal insulation barrier between rigid panels above in the exterior wall by aligning with the rigid panels below in a grade beam footing. The present invention overcomes prior art shortcomings by accomplishing these critical objectives.

SUMMARY OF THE DISCLOSURE

To minimize the limitations found in the prior art, and to minimize other limitations that will be apparent upon the reading of the specifications, the preferred embodiment of the present invention provides an improved thermal insulation barrier system that provides a continuous thermal insulation barrier for a grade beam, footing and wall assembly.

The present invention discloses an improved thermal insulation barrier system that is designed to be installed in a grade beam, footing and wall assembly. According to a first preferred embodiment, the improved thermal insulation barrier system of the present invention includes a plurality of insulation panels being interlocked and aligned beneath a building envelope and extending inside of the grade beam, footing and wall assembly. The plurality of panels is preferably aligned proximate to an exterior wall. The plurality of insulation panels are preferably held in place by fasteners, which attach to vertical and horizontal reinforcing members to form a substantially rectangular and rigid structure that is encased in the concrete grade beam.

According to a further preferred embodiment, the plurality of panels are interlocked utilizing a plurality of fasteners. The fasteners penetrate through the insulation panels and are locked into place with a back plate. The vertical reinforcing member is inserted into the slots of the plurality of fasteners to connect the plurality of rigid panels into a continuous thermal insulation barrier system. The improved thermal insulation barrier system thus provides the continuous thermal insulation barrier between the plurality of rigid panels above in the exterior wall system to align with the plurality of rigid panels below in the grade beam footing. Thus, the continuous thermal insulation barrier system provides an improved quality of installation of the plurality of insulation panels to withstand harsh construction conditions without thermal bridges.

In accordance with one embodiment of the present invention, the improved thermal barrier system includes predetermined layouts to place the system in the exact location for a proper thermal barrier, and have the ability to be installed square and plumb with the building envelope. Other exemplary embodiments provide an improved thermal insulation barrier system having increased ability to provide high performance insulation.

These and other advantages and features of the present invention are described with specificity so as to make the present invention understandable to one of ordinary skill in the art.

BRIEF DESCRIPTION OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention, thus the drawings are generalized in form in the interest of clarity and conciseness.

DETAILED DESCRIPTION OF THE DRAWINGS

In the following discussion that addresses a number of embodiments and applications of the present invention, reference is made to the accompanying drawings that form a part hereof, and in which is shown by way of illustration specific embodiments in which the invention may be practiced. It is to be understood that other embodiments may be utilized and changes may be made without departing from the scope of the present invention.

Various inventive features are described below that can each be used independently of one another or in combination with other features. However, any single inventive feature may not address any of the problems discussed above or only address one of the problems discussed above. Further, one or more of the problems discussed above may not be fully addressed by any of the features described below.

Reference is now made in detail to the exemplary embodiments of the invention, examples of which are illustrated in the accompanying drawings. As used throughout this application, the word "may" is used in a permissive sense (i.e., meaning "having the potential to"), rather than the mandatory sense (i.e. meaning "must").

Figure 1:
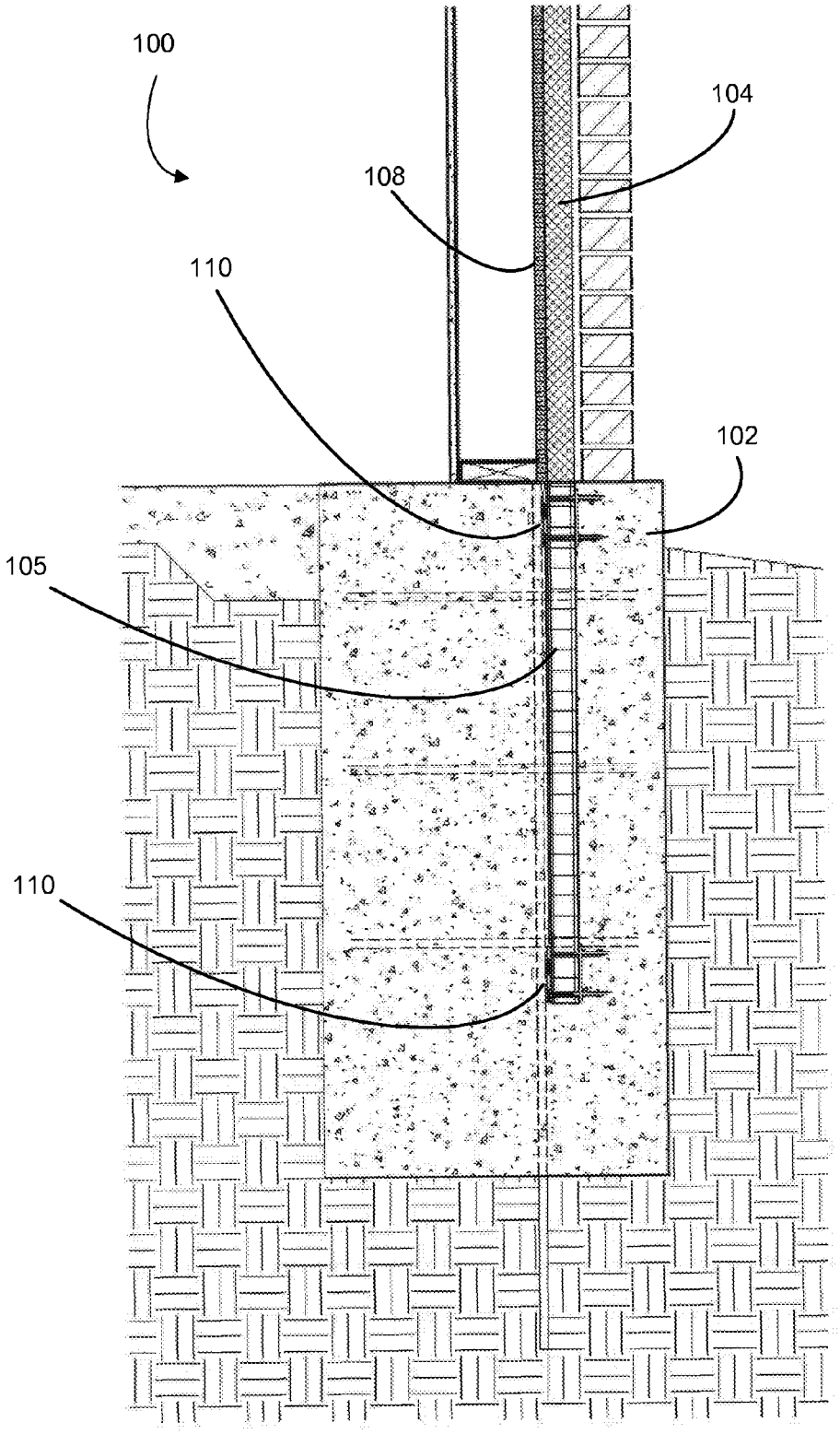
FIG. 1 is a cross-sectional view of an improved thermal insulation barrier system in accordance with a preferred embodiment of the present invention.

Referring now to FIG. 1, a preferred embodiment of the present invention is illustrated. As shown, the thermal insulation barrier system 100 of the present invention includes a panel system 105 which may be installed on or within a grade beam or footing 102. Preferably, the panel system 105 is aligned with exterior wall insulation 104 and within the building envelope. As further shown, the panel system 105 is preferably aligned proximate to an exterior wall 108 and arranged so that it extends down within the grade beam assembly 102 to maximize the insulated area. The panel system 105 may preferably further include one or more fastening elements 110 which will be discussed in more detail below.

Figure 2:
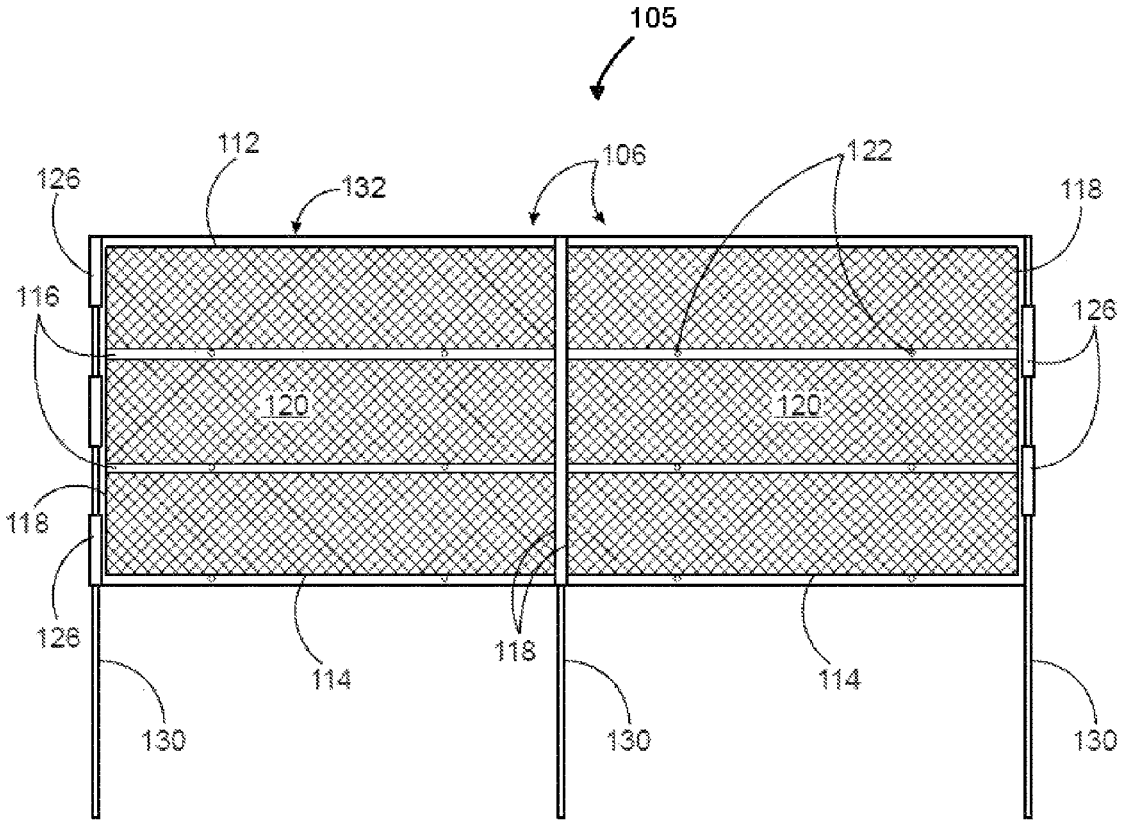
FIG. 2 is a side-view of a panel system in accordance with a preferred embodiment of the present invention.

Referring now to FIG. 2, a more detailed view of the panel system 105 shall now be discussed. As shown, the panel system 105 preferably includes a plurality of rigid panels 106. According to a preferred embodiment, the plurality of rigid panels 106 is constructed as an interlocking system that is installed and aligned with the building envelope. Preferably, the plurality of rigid panels 106 are provided with an adequate insulating layer to block thermal transfer and are constructed with standardized dimensions to meet all local codes for a thermal barrier. According to a preferred embodiment, the insulating layer is preferably formed from rigid polyisocyanurate foam. Alternatively, the insulating layer may be formed of any rigid foam material.

Referring again to FIG. 2, according to a preferred embodiment, each panel 106 is preferably enclosed in a frame 132 to form a substantially rectangular structure having a front wall 112, a back wall 114, a plurality of horizontal reinforcing members 116 and a pair of opposing lateral walls 118. The plurality of horizontal reinforcing members 116 are preferably positioned in an inner surface 120 of each panel 106. As further shown, the plurality of horizontal reinforcing members 116 may preferably include a plurality of openings 122 spaced horizontally at a predetermined interval. Each opening 122 is preferably adaptable to allow at least one building element (i.e. an electrical, plumbing or HVAC conduit) to pass through the panel 106. According to a further preferred embodiment, the pair of opposing lateral walls 118 may be attached with a plurality of side brackets 126. Each side bracket 126 may preferably further include a slot (not shown) for receiving a vertical reinforcing member 130.

Figure 3:
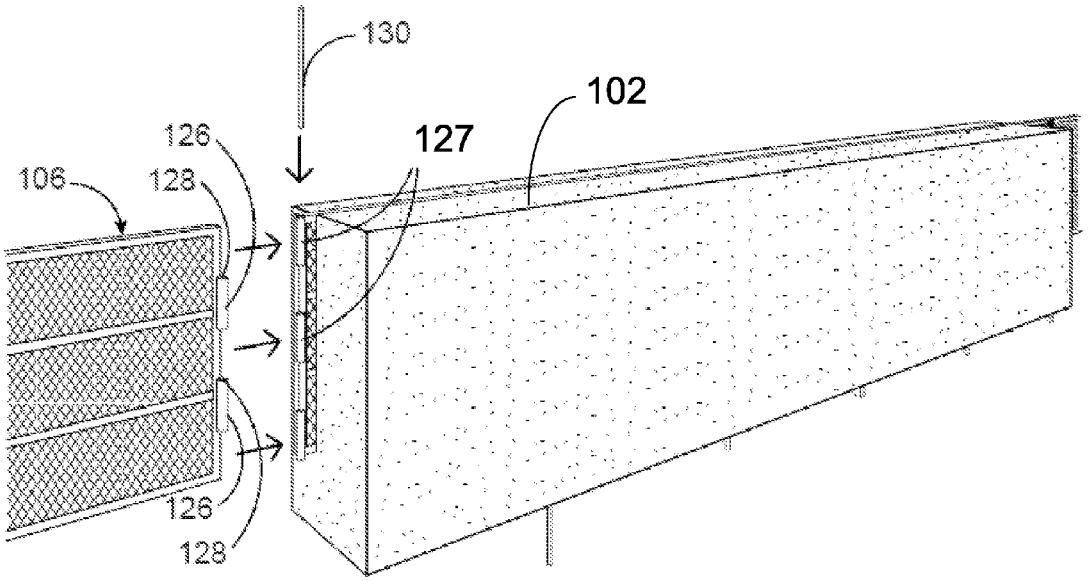
FIG. 3 is a perspective view of a preferred embodiment of the present invention.

Referring now to FIG. 3, a perspective view of a grade beam footing 102 incorporating the present invention is provided. As illustrated, a rigid panel 106 is positioned for connection with another adjoining panel (not shown) within the grade beam footing 102. Preferably, this connection is made by aligning and connecting the side brackets 126 of the rigid panel 106 with the side brackets 127 of next adjoining rigid panel (not shown). To secure this connection, a vertical reinforcing member 130 may preferably be inserted into the slots 128 of the plurality of side brackets 126 once they are aligned with the side brackets 127 of the next adjoining panel.

According to a further preferred embodiment, the rigid panels 106 may further include corner extrusions that allow installation of corners and angles that may stay consistent with a building footprint design. For the corner installation, ends of the plurality of rigid panels 106 are preferably cut to the correct length and then the plurality of rigid panels 106 are inserted into manufactured corner extrusions and fastened utilizing at least one fastener, which, for example, can be an internally or externally threaded connection pin.

Figure 4:
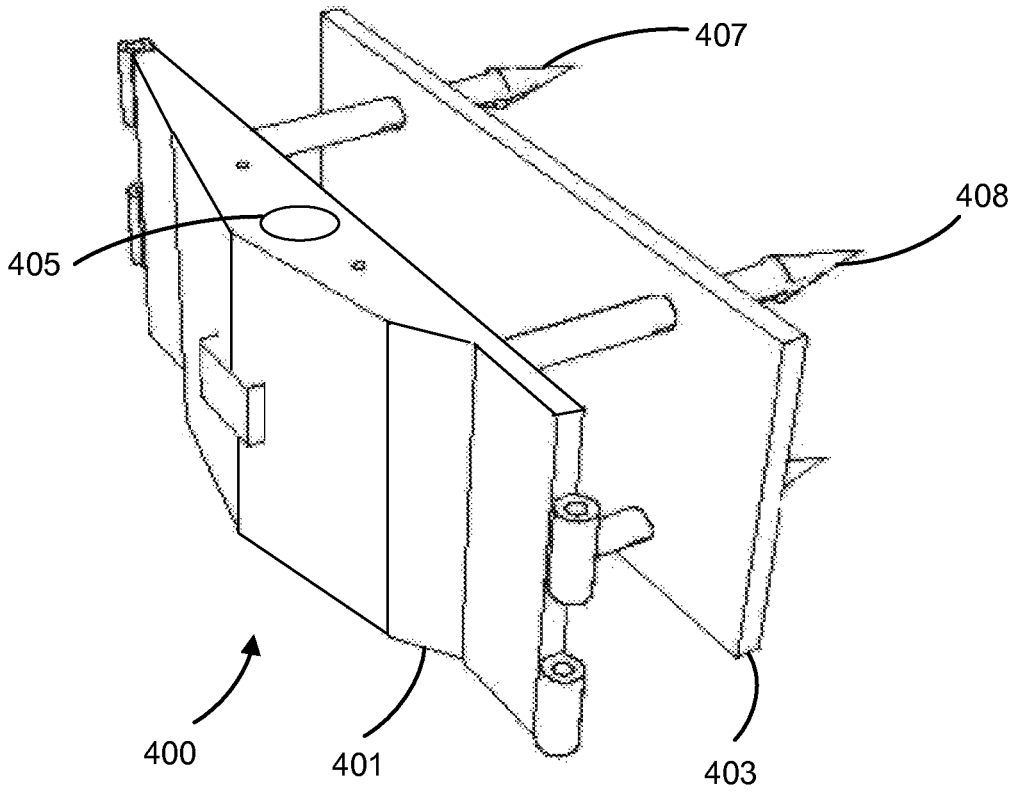
FIG. 4 is a perspective view of an individual fastener for use in embodiments of the present invention.

With reference now to FIG. 4, an exemplary fastening mechanism 400 is provided which may preferably be used to further or alternatively secure rigid panels 106 during installation. As shown, the exemplary fastening mechanism 400 preferably includes a front wall 401, a back plate 403, fastening pins 407 and 408, and a slot 405 for receiving a vertical reinforcing member (not shown). In use, the front wall 401 is preferably secured to two adjacent panels by using pin element 407 to run through a first panel and pin element 408 to run through a second panel. Once run through, the pin elements 407, 408 preferably further extend through and connect with the back plate 403. Once attached, the adjacent panels become interlocked at their seams.

Figure 5:
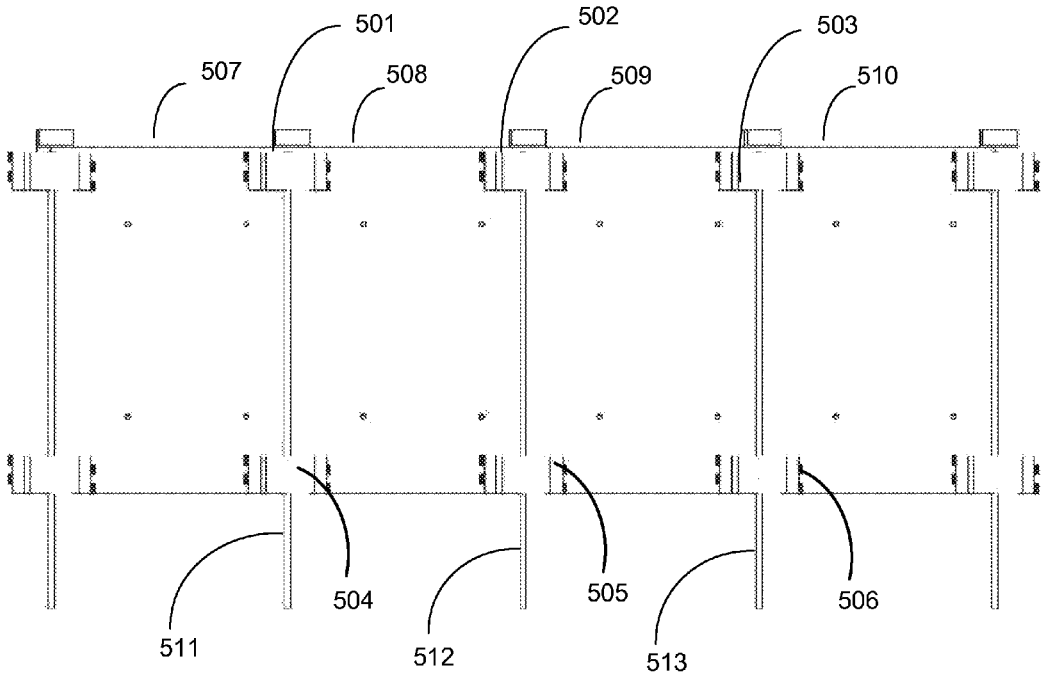
FIG. 5 is a perspective view of a grade beam footing illustrating the installation of an alternative preferred embodiment of the present invention.

FIG. 5 shows an alternative preferred embodiment illustrating the use of the exemplary fastening mechanism 400 discussed above. As shown in FIG. 5, a plurality of insulation panels 507, 508, 509, 510 are interlocked to each other utilizing a plurality of upper and lower fastening mechanisms 501, 502, 503, 504, 505, 506. Further, a group of vertical reinforcing members 511, 512, 513 are shown which extend through each fastening mechanism to provide support.

Figure 6:
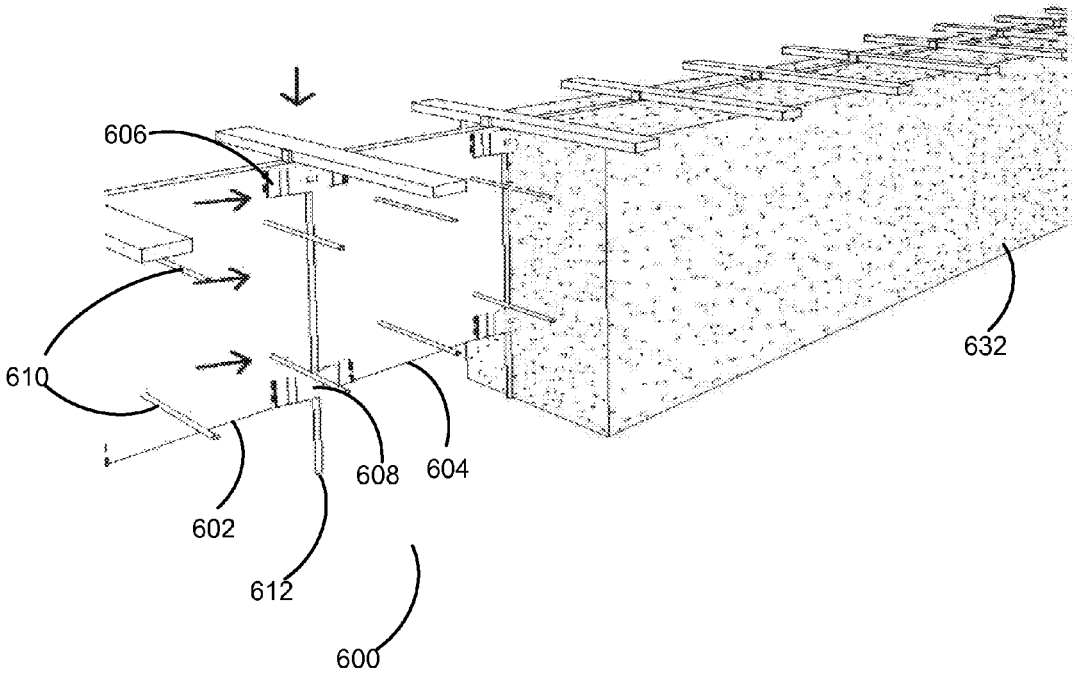
FIG. 6 is a side-view of a panel system in accordance with an alternative preferred embodiment of the present invention.

With reference now to FIG. 6, a further perspective view of a preferred alternative embodiment of the present invention will now be further discussed. As shown in FIG. 6, the improved thermal insulation barrier system 600 includes a plurality of insulation panels 602, 604 which are interlocked by fastening mechanisms 606 and 608. Further, each panel is shown secured by plurality of horizontal reinforcing members 610 and a vertical reinforcing member 612 which runs through and connects fastening mechanisms 606 and 608.

The foregoing description of the preferred embodiment of the present invention has been presented for the purpose of illustration and description. It is not intended to be exhaustive or to limit the invention to the precise form disclosed. Many modifications and variations are possible in light of the above teachings. It is intended that the scope of the present invention not be limited by this detailed description, but by the claims and the equivalents to the claims appended hereto.

What is claimed is:

1. An improved system for a thermal insulation barrier for use within a grade beam, footing and wall assembly, the system comprising:

a vertical reinforcing member;

first and second insulation panels, where the first and second insulation panels are comprised of:

a main panel section;

a frame section, wherein the frame section is a substantially rectangular structure extending around the perimeter of the main panel section;

a first lateral side wall;

a second lateral side wall;

a plurality of horizontal reinforcing members, wherein the horizontal reinforcing members extend through the main panel section and connect between the first and second lateral side walls;

further wherein at least one horizontal reinforcing member further comprises an opening for allowing a conduit to pass therethrough;

a first side bracket, wherein the first side bracket is attached to a first lateral side wall;

further wherein the first side bracket comprises a slot member which extends out beyond the first lateral side wall and which is configured to receive the vertical reinforcing member; and a second side bracket, wherein the second side bracket is attached to a second lateral side wall;

further wherein the second side bracket comprises a slot member which extends out beyond the second lateral side wall and which is configured to receive the vertical reinforcing member;

wherein the first side bracket of the first panel and the second side bracket of the second panel are positioned offset from each other so that the vertical reinforcing member can pass through the first side bracket of the first insulation panel and the second side bracket of the second insulation panel when they are vertically aligned;

wherein said thermal barrier installs vertically in-line with an exterior envelope of a building.

* * * * *